United States Patent [19]

Holten

[11] Patent Number: 4,788,469

[45] Date of Patent: Nov. 29, 1988

[54] MULTI-USE LAMP VESSEL AND AN INCANDESCENT LAMP

[75] Inventor: Petrus A. J. Holten, Weert, Netherlands

[73] Assignee: U.S. Philips Corp., New York, N.Y.

[21] Appl. No.: 22,159

[22] Filed: Mar. 5, 1987

[30] Foreign Application Priority Data

Feb. 25, 1987 [NL] Netherlands ..... 8700465

[51] Int. Cl.[4] ..... H01K 1/28; H01K 1/32

[52] U.S. Cl. ..... 313/113; 313/114; 362/302

[58] Field of Search ..... 313/113, 114, 115, 317; 362/302

[56] References Cited

U.S. PATENT DOCUMENTS 1,804,049 5/1931 Claus ..... 313/114

2,110,590 3/1938 Cook ..... 313/114

*Primary Examiner*—David K. Moore

*Assistant Examiner*—Theodore Salindong

*Attorney, Agent, or Firm*—Brian J. Wieghaus

[57] ABSTRACT

The electric incandescent lamp has a multi-use lamp vessel having a neck-shaped wall portion, a wall portion which is curved in accordance with a first circuit arc and extends substantially in the transverse direction, and a wall portion which is curved in accordance with a second circular arc and extends substantially in the axial direction. A filament is arranged in the proximity of the largest diameter. The electric incandescent lamp has the advantage that, independent of its finish it has a lamp vessel of the same shape and the same mounting means for the filament. The manufacture of incandescent lamps of different types is thereby simplified considerably.

12 Claims, 2 Drawing Sheets

MULTI-USE LAMP VESSEL AND AN INCANDESCENT LAMP

BACKGROUND OF THE INVENTION

The invention relates to an electric incandescent lamp comprising a blown glass lamp vessel or envelope sealed in a vacuum-tight manner having an axis of symmetry and a largest diameter transverse to the axis of symmetry.

A neck-shaped first wall portion is behind the largest diameter and has a free end carrying a lamp cap having electric contacts. The lamp vessel has an internally concave second wall portion and an internally concave third wall portion. An internally concave fouth wall portion is located opposite the lamp cap in front of the largest diameter. A helically wound filament is supported about the axis of symmetry substantially in a transverse plane. Current supply conductors interconnect the filament and contacts on the lamp cap. The invention also relates to a blown glass bulb suitable for use in the lamp.

A lamp of this type is known from U.S. Pat. No. 2,110,590.

In the known lamp the second wall portion together with a reflector arranged within the neck-shaped wall portion constitutes half an ellipse when viewed in axial cross-section. The third wall portion is a branch of a parabola which is revolved about an axis parallel to the parabola axis, with the parabola axis being located between the branch of the parabola and the axis of revolution. The two wall portions are mirror coated and their foci are located on a circle. The filament is arranged in the plane through these foci.

The known lamp provides a solution to the problem of parabolic reflectors being too narrow in the focal plane if the filament is to be mounted in a deep reflector so as to obtain a satisfactory beam of generated light and avoids the transverse dimensions of the lamp exceeding a conventional size.

As in the known lamp the branches of the parabola are moved apart in an axial cross-section so that the lamp vessel in the focal plane is wider. Yet the filament in the focal plane is located in a narrow portion of the lamp vessel, remote from the largest diameter of the lamp vessel. A drawback of the known lamp therefore is that only filaments consuming a relatively low power can be mounted in the lamp vessel in order to avoid overheating of the lamp vessel.

Electric lamps having a power value between 15 and 100 W, for example 15, 25, 40, 60, 75 and 100 W intended to be operated at a standard voltage are manufactured in a large number of types. The finish, the coating and the processing of the lamp vessel wall, and also its shape and the size and shape of the inner parts of the lamp are different.

The electric incandescent lamps for operation at the mains voltage in the said power range include:

lamps such as those described in the above-cited U.S. Pat. No. 2,110,590, having a mirror-coated parabolically curved wall portion opposite to which a window is located. The window is glazed (is slightly light-scattering) for example due to an etching treatment and/or is colored;

lamps having a substantially spherical lamp bulb which is transparent or is frosted or which is coated with a white or colored light-scattering layer;

lamps having a conical wall portion adjacent to, and a curved wall portion opposite to the neck-shaped wall portion, the conical wall portion being provided with a white or colored light-scattering layer and the curved wall portion being slightly light-scattering and, as the case may be, being colored. These lamps emit light on all sides, but supply along the axis is directions opposite the neck-shaped wall portion a higher luminous intensity than in other directions; and lamps having opposite to the neck-shaped wall portion a spherical wall portion which is mirror-coated or is provided, for example with a white light-scattering coating.

The manufacture of this large number of lamp types is very complicated due to the variety of lamp vessel types which require on and between the production machinery their own supply and lead-out mechanisms and their own transport means, and which moreover require individual packaging. The readjustment of production machines from one lamp type to the other is thus a very laborious operation. Another complication of their manufacture is that the various types of lamps require their own means to keep the filament positioned.

SUMMARY OF THE INVENTION

It is an object of the invention to provide an electric incandescent lamp having a blown glass lamp vessel shaped in such a way that the lamp vessel may have a coating or optional processing operation for realising lamps of a variety of different types. It is also an object of the invention to provide a blown glass lamp bulb suitable for use in such an electric incandescent lamp.

According to the invention, in an electric incandescent lamp of the type described in the opening paragraph this object is realized in that the second wall portion in axial cross-section is substantially curved in accordance with an arc of a circle and extends mainly in the transverse direction between the neck-shaped wall portion and the largest diameter. Its center of curvature being located in front of the largest diameter on the other side of the axis of symmetry, the third wall portion in the axial cross-section is substantially curved in accordance with an arc of a circle and extends mainly in axial direction in front of the largest diameter. The center of curvature is located behind the largest diameter and on the other side of the axis of symmetry. The third wall portion gradually merges into the second wall portion in the proximity of the largest diameter. The filament is arranged in the proximity of the largest diameter.

Since the second wall portion mainly extends in the transverse direction when viewed in axial cross-section, the lamp vessel widens out considerably from the neck-shaped wall portion. This is in great contrast to the lamp of the above-cited U.S. Pat. No. 2,110,590. Even if the lamp has a conventional axial dimension this also results in the possibility of arranging the filament in the proximity of the largest diameter of the lamp vessel and yet positioned deep in the lamp vessel, i.e. relatively close to the neck-shaped wall portion.

This has great advantages. For a largest diameter of e.g. approximately 60 mm which is conventional for commercial lamps using a low power (for example 25 W), filaments having a relatively high power (for example 75 or 100 W) can be incorporated due to their position in the proximity of the largest diameter. In front of the largest diameter the lamp still has a considerable axial dimension so that in mirror coated embodiments the filament is surrounded by mirror coated wall portions over a large spatial angle.

BRIEF DESCRIPTION OF THE DRAWINGS

The invention will now be described in greater detail with reference to the accompanying drawings which show embodiments of the lamp according to the invention.

In the drawings.

DESCRIPTION OF THE PREFERRED EMBODIMENTS

Figure 1:
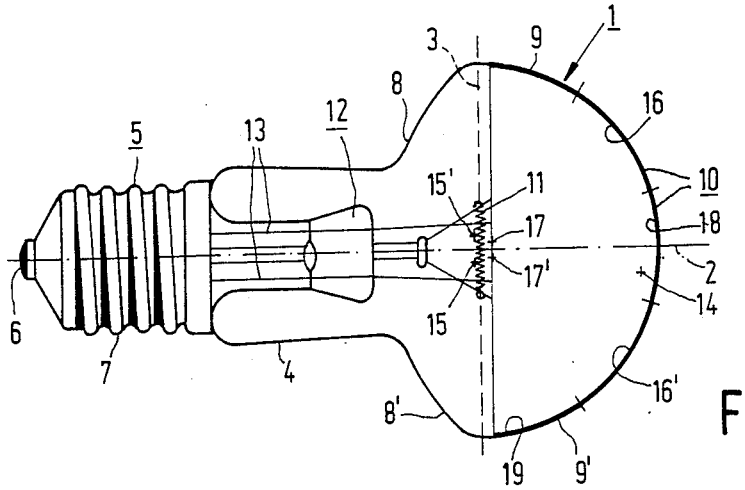
FIG. 1 is a side elevation of a first embodiment of a lamp with the lamp vessel in axial cross-section.

In FIG. 1, the electric incandescent lamp has a blown glass lamp vessel 1 which is sealed in a vacuum-tight manner and which has an axis of symmetry 2, a largest diameter 3 transverse to the axis of symmetry and a neck-shaped first wall portion 4 behind the largest diameter 3. The free end of the neck-shaped wall portion 4 carries a lamp cap 5 which has electric contacts 6, 7. The lamp vessel 1 also has an internally concave second wall portion 8, 8', an internally concave third wall portion 9, 9', and an internally concave fourth wall portion 10 located opposite the lamp cap 5 in front of the largest diameter 3. A helically wound filament 11 is arranged about the axis of symmetry 2 substantially in a plane transverse to this axis. The lamp has means 12 to keep the filament positioned and current supply conductors 13 which interconnect the filament 11 and contacts 6, 7 on the lamp cap 5.

The second wall portion 8, 8' is curved in axial cross-section substantially in accordance with an arc of a circle and extends mainly in the transverse direction between the neck-shaped wall portion 4 and the largest diameter 3. The dimensions of the lamp vessel 1 from the neck-shaped wall portion 4 to the largest diameter 3 increase to a greater extent in the transverse direction than in the axial direction. The center of curvature 14 of the wall portion 8 is located in front of the largest diameter 3 on the other side of the axis of symmetry 2. The mainly transverse direction in which the wall portion 8 extends implies that the center of curvature 14 is relatively remote from the largest diameter 3.

The third wall portion 9,9' is curved with a circular arc when viewed in axial cross-section and extends substantially in the axial direction in front of the largest diameter 3. The dimensions of the lamp vessel 1 from the largest diameter 3 increase to a greater extent in the axial direction than they decrease in the transversal direction. The wall portion 9 has a center of curvature 15 which is located behind the largest diameter 3 on the other side of the axis of symmetry 2. The wall portion 9, 9' gradually merges in the proximity of the largest diameter 3 into the second wall portion 8, 8'.

The filament 11 is arranged in the proximity of the largest diameter 3.

In a favorable embodiment the fourth wall portion 10 is curved in axial cross-section in a zone remote from the axis of symmetry substantially in accordance with an arc of a circle, the center of curvature being located proximate to the axis of symmetry and in front of the filament. This embodiment has the advantage that the lamp may be in the form of a bowl-mirror lamp. In that case the lamp has a reflective coating on the wall portions in front of the filament. Such a lamp may alternatively have, for example a white partly reflective, partly light-transparent coating on said wall portion.

FIG. 1 shows this shape. The fourth wall portion 10 has an annular zone 16, 16' remote from the axis of symmetry 2 in which the wall portion in the axial cross-section is substantially curved in accordance with an arc of a circle. The center of curvature 17 of the zone 16 is located proximate to the axis of symmetry 2 and in front of the filament 11. In the region 18 in the immediate proximity of the axis 2 the fourth wall portion 10 may have a larger radius of curvature, or it may be ogive. In FIG. 1 a reflective coating with, for example aluminium, silver, copper/aluminium, or gold is denoted by the reference numeral 19. The Figure shows that the filament 11 is at a relatively large distance from the wall of the lamp vessel 1 in all directions.

A lamp vessel 1 of the same shape as in FIG. 1 may be entirely transparent or substantially frosted. Alternatively this lamp vessel may have a light-scattering coating possibly comprising white or coloured pigment. In a special embodiment this lamp vessel 1 has a white light-scattering coating on the wall portions 4, 8, 8' and 9, 9' and the wall portion 10 is glazed or has a coating which is not pigmented or is pigmented to a slight extent. In that case the lamp emits more light in the forward direction, in directions which extent at a relatively small angle to the axis 2, than when the entire lamp vessel is provided with the same coating. The lamp has a smaller lateral luminance. In all these embodiments the same stem 12 can be used to keep the filament 11 positioned.

It is an advantage that the same means and the same stem can be used to keep the same filament positioned when constructing the lamp according to the invention as a reflector lamp.

The invention also relates to a blown glass bulb suitable for use in the electric incandescent lamp according to the invention. An important property of the bulb is that it is mechanically strong. The bulb is therefore suitable to be evacuated for manufacturing vacuum lamps or for the manufacture of mirror coatings.

In FIGS. 2–5 identical parts have the same reference numerals as in FIG. 1.

The lamp vessel 21 is provided with a mirror coating 29 on its inner surface on the wall portions 8, 8' and 9, 9' as well as on a part of the wall portion 4.

Figure 2:
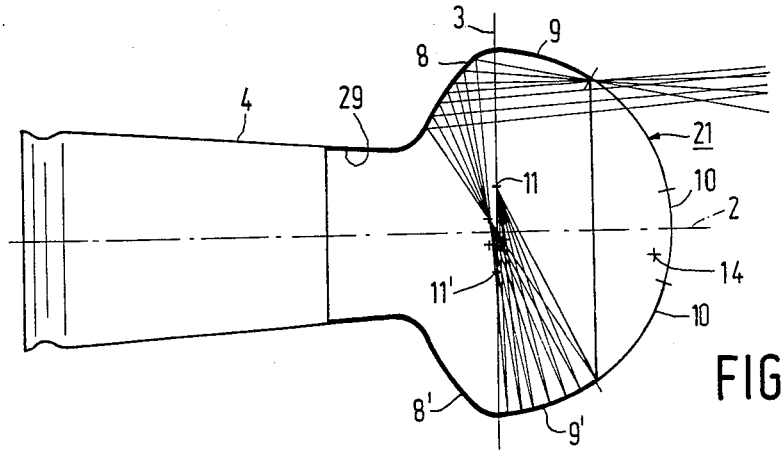
FIGS. 2–5 show a mirror coated blown glass bulb in axial cross-section suitable for use in a second embodiment of the lamp

FIG. 2 shows the radiation path for light which is emitted by the filament at point 11 in the direction of wall portion 9' and which is reflected by this wall portion. The wall portion 9' thus constitutes a screen preventing light from emerging at large angles to the axis 2. The wall portion 9' reflects the incident light backwards to the wall portion 8 which throws the light in forward directions to the exterior through the wall portion 10 which functions as a light window. It is remarkable that although wall portion 9' constitutes a screen to the said light rays the wall portion 9 is no hindrance or substantially no hindrance for the emerging rays reflected by wall portion 8.

Figure 3:
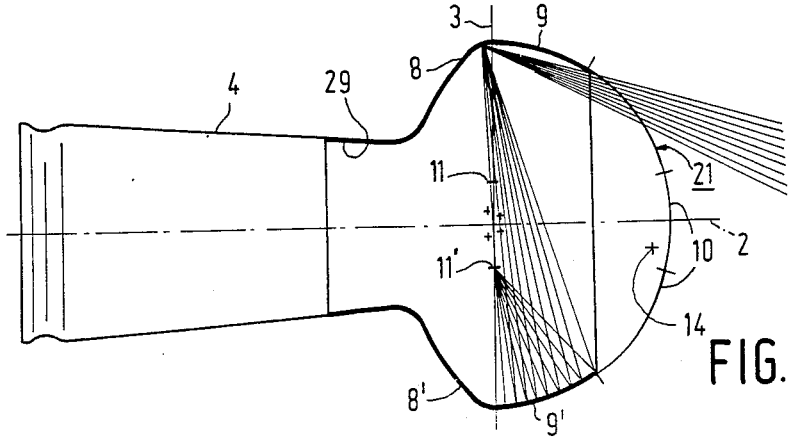

FIG. 3 shows that rays thrown onto wall portion 9' from point 11' of the filament are also reflected to wall portion 8 and are subsequently thrown to the exterior by this portion 8 without wall portion 9 essentially intercepting rays.

Figure 4:
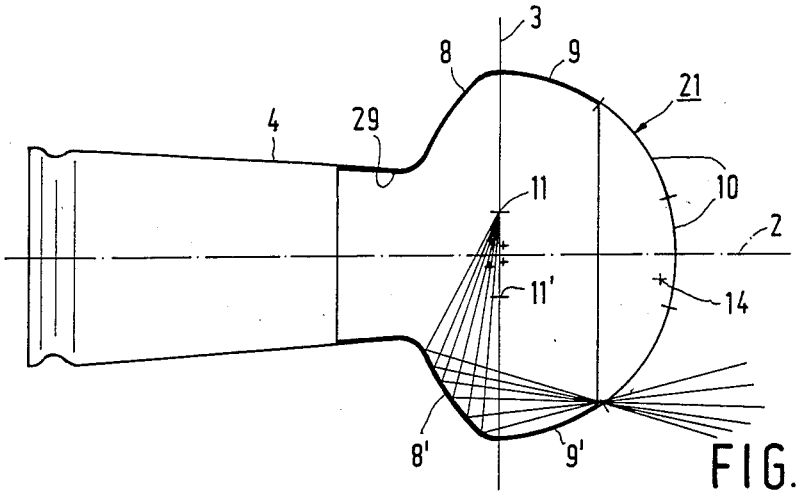

It is apparent from FIG. 4 that rays thrown onto the wall portion 8' from point 11 of the filament are reflected and can emerge to the exterior through the light window 10 without any hindrance or any substantial hindrance by the wall portion 9'.

Figure 5:
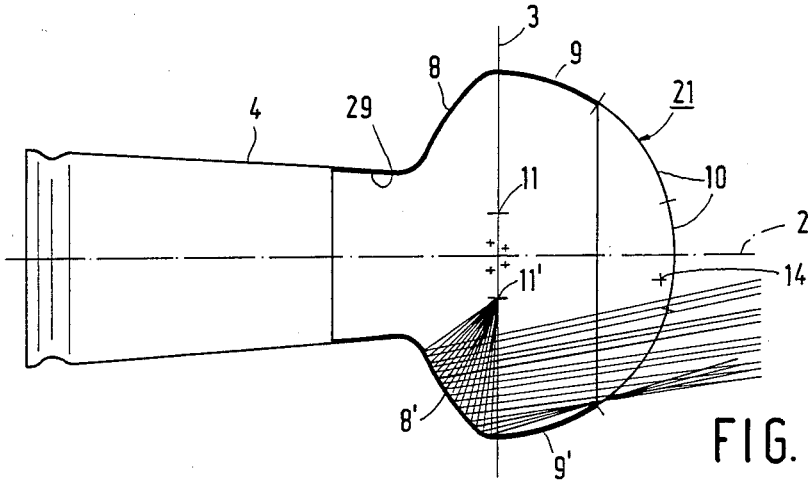

FIG. 5 also shows that rays which are thrown onto wall portion 8' by the filament at 11' are also thrown to the exterior through this wall portion without any hindrance or any substantial hindrance by wall portion 9'.

In view of the symmetry of the bulb 21 there is a corresponding radiation path in a lamp from this bulb of light rays which are directly incident on wall portion 8 or on wall portion 9.

The mirror-coated wall portion 9, 9' thus has a multiple function: (a) it prevents the emergence of light at large angles to the axis 2, (b) it co-operates with the main reflector which is constituted by the wall portion 8, 8' and (c) it is at least substantially no hindrance for rays reflected by wall portion 8, 8'.

The beam components shown in FIGS. 2–5 are intensified by light which emerges directly without reflection. The mirror coated wall portions 8, 8' and 9, 9' surround the filament 11, 11' in a finished lamp over a spatial angle of approximately 2.5 $\pi$ sr so that a considerable part of the generated light is concentrated to a beam, also without a reflector body being arranged in the neck-shaped wall portion 4.

The filament may be arranged in various shapes, for example substantially as an open circle or along three sides of an isosceles trapezium.

In one embodiment of the lamp according to the invention the parabolically curved wall portion has a relief in a zone in the proximity of the neck-shaped wall portion. The wall portion may be roughened, frosted or glazed in this zone. On the other hand, a ripple may be superimposed on the wall portion in the axial cross-section. The amplitude thereof may decrease with an increasing distance to the neck-shaped wall portion. Such a relief can homogenize the luminous intensity in the light beam of the lamp in its reflector design. A ripple superimposed on the second wall portion is advantageous because it can be formed on the bulb while blowing it.

Figure 6:
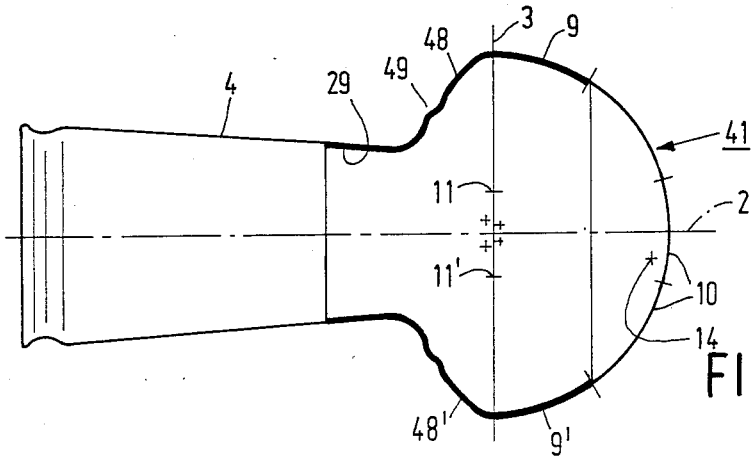
FIG. 6 shows a modification of the bulb of FIGS. 2–5 in axial cross-section.

In FIG. 6 the second wall portion 48, 48' of the bulb 41 has a relief in a zone proximate to the neck-shaped wall portion 4. A ripple 49 having an amplitude decreasing with an increasing distance to the neck-shaped wall portion 4 is superimposed on this wall portion.

A lamp which was manufactured from the bulb shown in FIGS. 2–5 and which had a largest diameter of 60 mm, and consumed a power of 40 W at 225 V, had a filament which was arranged along four sides of an equilateral pentagon. The lamp produced a light beam having a center value of 550 cd (candela) and a beam width of $2° \times 15°$.A commercial reflector lamp of the same power and a largest diameter of 63 mm produces a beam having a center value of 450 cd at the same beam width. Within the said angle the luminous flux of the lamp according to the invention was 35% larger than that of the commercial lamp.

An electric incandescent lamp also having mirror-coated co-operating wall portions is known from GB Pat. No. 2,097,997 corresponding to U.S. Pat. No. 4,506,185. A mirror-coated wall portion widening considerably in the proximity the neck of the lamp vessel is a paraboloid in this lamp. A mirror-coated spherical wall portion is located opposite to it. These two wall portions are connected by an annular wall portion extending in a substantially transverse direction. The known lamp combines the functions which are normally fulfilled by a bowl-mirror lamp together with an external paraboloidal reflector. The spherical reflector throws light on the paraboloidal reflector which has to throw the light to the exterior.

The known lamp has a number of drawbacks. The filament is arranged at the largest diameter of the lamp vessel, and is also surrounded by the spherical wall portion which is located close to it. Consequently the lamp can only comprise filaments using a relatively low power.

The spherical wall portion throws light on the paraboloidal mirror-coated wall portion but also screens off a considerable part of this wall portion because the spherical wall portion must be relatively voluminous from a thermal point of view. Finally, due to its shape the known lamp vessel is mechanically relatively weak.

What is claimed is:

1. A multi-use symmetrical lamp envelope, comprising:

(a) a neck-shaped first portion;

(b) an internally concave second portion extending outwardly from said neck shaped portion and terminating at the largest diameter of said lamp envelope, said second portion extending more in a direction transverse to the axis of symmetry of said envelope than along said axis, said second portion being a body of revolution of a first circular arc about said axis of symmetry, said axis of symmetry being between the center of curvature of said first circular arc and said first circular arc, said center of curvature of said first circular arc being in a region which extends from said largest diameter away from said second portion;

(c) an internally concave third portion smoothly merging with said second portion at said largest diameter and extending away from said largest diameter more along said axis of symmetry than transverse to said axis of symmetry, said third portion being a body of revolution of a second circular arc about said axis of symmetry, said axis of symmetry lying between the center of curvature of said second circular arc and said second circular arc, said center of curvature of said second circular arc lying in a region which extends from the largest diameter towards said neck-shaped portion; and (d) an internally concave fourth wall portion opposite said first and second portions joining said third portion.

2. A lamp envelope as claimed in claim 1, wherein said fourth wall portion comprises in an annular zone remote from said axis of symmetry a body of revolution of a third circular arc about said axis of symmetry, the center of curvature of said third circular arc being located proximate to said axis of symmetry and in a region extending from the largest diameter to said fourth wall portion.

3. A lamp envelope as claimed 2, wherein said third portion and said fourth portion have a mirror coating.

4. A lamp envelope as claimed claim 1, wherein said second portion and said third portion have a mirror coating.

5. A lamp envelope as claimed in claim 4, wherein said lamp envelope comprises a relief in an annular zone in said second portion.

6. A lamp envelope as claimed in claim 5, wherein said relief comprises a ripple having an amplitude which diminishes with increasing distance from said neck-shaped portion.

7. An incandescent lamp, comprising:

(a) a symmetrical lamp envelope comprising a neck shaped first portion, an internally concave second portion extending outwardly from said neck shaped portion and terminating at the largest diameter of said lamp envelope, said second portion extending more in a direction transverse to the axis of symmetry of said envelope than along said axis, said second portion being a body of revolution of a first circular arc about said axis of symmetry, said axis of symmetry being between the center of curvature of said first circular arc and said first circular arc, said center of curvature of said first circular arc lying in a region which extends from said largest diameter away from said second portion, an internally concave third portion smoothly merging with said second portion at said largest diameter and extending away from said largest diameter more along said axis of symmetry than transverse to said axis of symmetry, said third portion being a body of revolution of a second circular arc about said axis of symmetry, said axis of symmetry lying between the center of curvature of said second circular arc and said second circular arc, said center of curvature of said second circular arc being in a region which extends from the largest diameter towards said neck-shaped portion, and an internally concave fourth wall portion opposite said first and second portions joining said third portion;

(b) a lamp base secured on said neck portion;

(c) a filament energizable for emitting light; and (d) means for supporting said filament within said lamp envelope with a portion of said filament proximate said largest diameter.

8. An incandescent lamp as claimed in claim 7, wherein said filament is planar and is disposed in a plane transverse to the axis of symmetry.

9. An incandescent lamp as claimed in claim 7, wherein said fourth wall portion comprises in an annular zone remote from said axis of symmetry a body of revolution of a third circular arc about said axis of symmetry, the center of curvature of said third circular arc being located proximate to said axis of symmetry and in a region extending from the largest diameter to said fourth wall portion.

10. An incandescent lamp as claimed 9, wherein said third portion and said fourth portion have a mirror coating.

11. An incandescent lamp as claimed claim 7, wherein said second portion and said third portion have a mirror coating.

12. An incandescent lamp as claimed in claim 11, wherein said second wall portion further comprises a ripple in an annular zone about the axis of symmetry.

* * * * *